United States Patent [19]

Surakka et al.

[11] 4,219,166

[45] Aug. 26, 1980

[54] DISK DEFIBRATOR

[75] Inventors: Jorma Surakka; Martti Pokkinen; Jorma Makkonen; Erkki Valkama; Viljo Kärkkäinen; Pekka Räbinä; Jouni Matula, all of Savonlinna, Finland

[73] Assignee: Enso-Gutzeit Osakeyhtio, Helsinki, Finland

[21] Appl. No.: 918,093

[22] Filed: Jun. 22, 1978

[51] Int. Cl.[2] ..... B02C 7/06

[52] U.S. Cl. ..... 241/246; 241/251

[58] Field of Search ..... 241/244–247, 241/251

[56] References Cited

U.S. PATENT DOCUMENTS

| | | | |
|---|---|---|---|
| 4,059,237 | 11/1977 | Mannstrom | 241/246 |
| 4,132,366 | 1/1979 | Engall | 241/245 |

*Primary Examiner*—Mark Rosenbaum

*Attorney, Agent, or Firm*—Toren, McGeady and Stanger

[57] ABSTRACT

Disk defibrator presenting a feed device for supplying the material which one desires to defibrate, such as wood chips, into the throat of the disk defibrator with the aid of a screw conveyor, the steam generated during the defibration process escaping through the feed device in countercurrent to the material flow and further passing to the atmosphere through an exit aperture on the feed device. The feed device includes two feed screws side by side with an intervening space into which the steam freely discharges.

1 Claim, 2 Drawing Figures

DISK DEFIBRATOR

Figure 1:
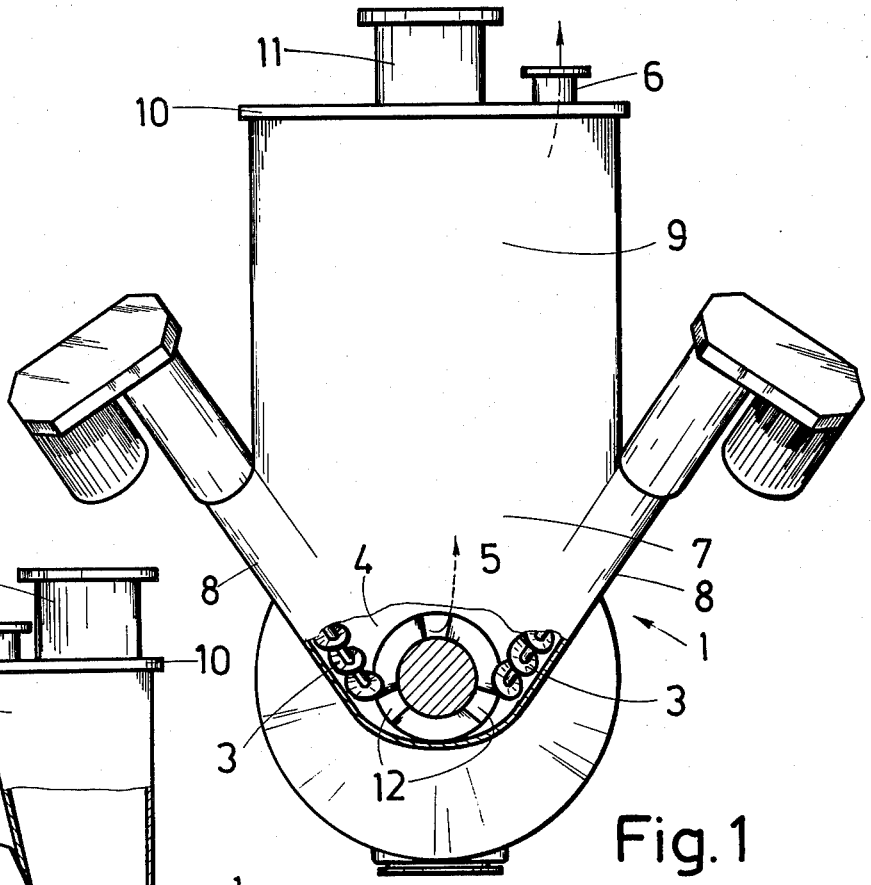

When pulp suitable for use in paper manufacturing is produced by the so-called thermomechanical method from raw material that is to be defibrated, for instance from wood chips or sawdust, the defibration is usually accomplished with one single disk defibrator, which consumes a high energy for the defibration process. This energy is largely converted into heat in the grinding zone between the cutters of the disk grinder, and this heat evaporates the water present in the material that is being defibrated, whereby a remarkable quantity of steam is generated. This steam tends to escape either in counterflow to the material arriving for defibration or along with the departing pulp into the housing enclosing the disks of the defibrator. The proportions of the steam quantity discharging against the feed direction and that escaping along with the pulp into the housing of the disk defibrator is determined by the degree of grinding and by the kind of grinding cutters used. These, in turn, are dependent on the process requirements, which are imposed by the desired quality of pulp that has to be turned out. Thus, it is not possible within any wide limits to act on the quantity of steam coming out in the direction opposing the feedin, by changing the degree of grinding and/or the cutters.

When in the defibration process ample amounts of energy are used, as is common for instance in the manufacturing of thermomechanical pulp with a double disk defibrator, the quantity or steam produced is quite remarkable (in the order of 2 to 6 kg per second). Such a steam flow causes feeding trouble in the disk defibrator, even to such extent that at the highest ratings the feed is interrupted altogether because in that case the flow velocity of the steam that is generated, and the pressure resulting therefrom, are so high that the feed means is unable to supply material for defibration into the throat of the defibrator.

The object of the present invention is to provide a disk grinder of a novel type wherein the above-mentioned drawbacks have been eliminated. The disk grinder of the invention is characterized in that the feed means comprises side by side two feed screws, with a space between them into which the steam freely discharges. It is thus understood that with the aid of the invention material to be defibrated can be uniformly fed from two sides into the throat of the grinding disks. There remains between and above the screws for the generated steam a space of sufficient volume, into which the steam may freely discharge without interfering with the material that is being transported by the feed screws.

A favourable embodiment of the invention is characterized in that the feed means consists of an upwardly widening, flat funnel-like chamber, in which the feed screws are located in depressions on both margins, as far removed from each other as possible, of the chamber. The space into which the steam emerging from the throat discharges is therefore funnel-shaped too, and the flow velocity of the steam decreases appreciably as it discharges into the said space. The material to be defibrated entering the feed means flows, owing to the funnel shape of the container, readily down along the margins to the feed screws, which further supply the material into the throat of the cutter disks.

The invention is described in the following with the aid of an example, with reference being made to the attached drawing, wherein:

FIG. 1 presents a disk defibrator according to the invention, viewed in axial direction and partly sectioned.

Figure 2:
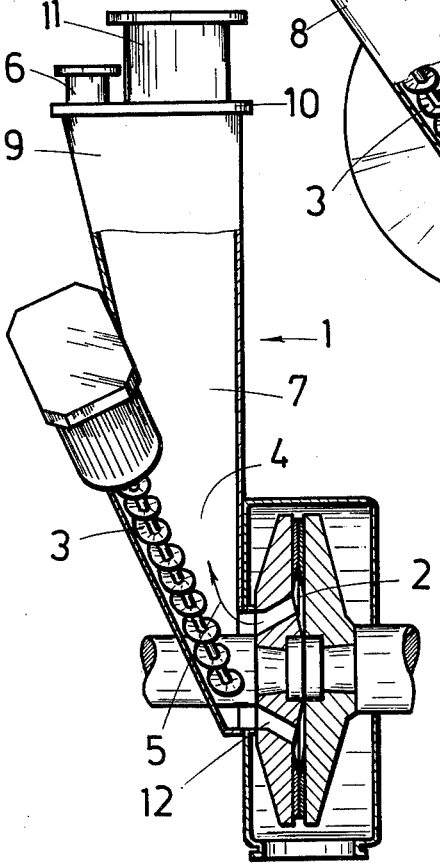

FIG. 2 shows disk defibrator in elevational view and partly sectioned.

In the disk defibrator of the invention there is found a feed means 1 for supplying material to be defibrated, such as wood chips for instance, into the throat 2 of the disk defibrator. The disk defibrator includes a first housing containing the grinding disks. The grinding disks rotate about a substantially horizontal axis. The feed means 1 comprises two feed screws 3 mounted side by side and extending downwardly and inclined inwardly toward one another terminating at the throat. An intervening space 4 is located between the lower ends of the feed screws, into which the steam produced during the defibration process will freely discharge from the throat 2 against the material flow in the direction indicated by the arrow 5. The steam further passes into atmosphere through the vent aperture 6 on the feed means.

The feed means consists of a second housing extending upwardly from the first housing and forming an upwardly widening, flat and funnel-like chamber 7. The feed screws 3 are located in depressions 8 on both inclined margins or sides in the lower part of the second housing, as far removed from each other as possible. The upper part of the chamber 7 above the feed screws constitutes a container 9, carrying in its cover 10 an input aperture 11 and the steam vent aperture 6.

With the aid of the invention the material arriving at the feed means can be caused, thanks to the funnel shape of the chamber 7, to be uniformly distributed between the feed screws 3 within the chamber. The feed screws supply the material uniformly forward through the feed apertures 12 into the throat 2 of the grinding disks. For the steam generated during the defibration process there remains between the screws 3 a funnel-shaped space 7 of upwardly increasing cross-section, into which the steam may flow in the direction indicated by the arrow 5, and whence it flows onward through the container 9 to the vent aperture 6.

It is obvious to a person skilled in the art that different embodiments of the invention may vary within the scope of the claims presented below.

We claim:

1. Improvement in a disk defibrator comprising a first housing, grinding disks located within said first housing forming a throat therebetween, said grinding disks rotating around a horizontally extending axis, said first housing including an upwardly extending wall extending transversely of the axis of rotation of said grinding disks and having an opening therethrough for receiving material to be defibrated, feed apertures in one of said disks for passing the material from the opening in said wall of said first housing into the throat, feed means for conveying material to and through the opening in said wall of said first housing, wherein the improvement comprises that said feed means comprises an upwardly extending second housing having a lower end wall, an upper end wall, a first pair of upwardly extending oppositely arranged walls disposed transversely of the axis of said grinding disks and extending between said lower and upper end walls and a second pair of upwardly extending oppositely arranged walls disposed transversely of said first pair and extending between said first pair of walls and between said lower and upper end walls, the lower end of one of said first pair of walls adjacent said lower end wall having an opening therethrough aligned with and in communication with the opening for receiving materials in said first housing, said second housing having a lower part extending upwardly from said lower end wall for a portion of the height of said second housing from said lower end wall to said upper end wall and an upper part extending upwardly from the upper end of said lower part, in said lower part said second pair of walls converging inwardly toward one another in the downward direction to said lower end wall with the lower ends of said second pair of walls being spaced apart and located on the opposite sides of the opening in said second housing into said first housing, each of said second pair of walls in said lower part of said second housing having a depression formed therein, a feed screw located in each said depression with said feed screws converging in the downward direction and with the lower ends of said feed screws being located at the opposite sides of the opening from said second housing into the opening in said first housing, said lower part of said second housing between said feed screws and said first pair of walls defining an open space for the flow of steam from the throat in said grinding disks in said first housing through the opening in said housing and the opening in said second housing into the open space in the lower part of said second housing with the steam in communication with said feed screws so that the steam can flow upwardly through the lower part between said feed screws and in counterflow relation to the material to be defibrated into the upward part of said second housing without encountering the material being conveyed downwardly by said feed screws, said one of said first pair of walls having the opening therethrough extending upwardly from said first housing approximately perpendicularly to the axis of rotation of said grinding disks, the other of said first pair walls being disposed in diverging relation to said one of said first pair of walls so that the continuation of the open space within said second housing from said lower part upwardly through said upper part increases in cross sectional area, said first and second pairs of walls forming a funnel-shaped space within said second housing, and said upper end wall having a steam vent formed therethrough for venting from said upper part of said second housing.

* * * * *

UNITED STATES PATENT OFFICE

CERTIFICATE OF CORRECTION

Patent No. 4,219,166 Dated August 26, 1980

Inventor(s) Jorma Surakka, et al

It is certified that error appears in the above-identified patent and that said Letters Patent are hereby corrected as shown below:

In the heading of the patent [30] should read as follows:

[30] Foreign Application Priority Data

May 26, 1978 Finland.....781672

Signed and Sealed this

*Eighteenth* Day of *November 1980*

[SEAL]

*Attest:*

SIDNEY A. DIAMOND

*Attesting Officer* *Commissioner of Patents and Trademarks*